US011226135B2

(12) United States Patent
Glanville et al.

(10) Patent No.: US 11,226,135 B2
(45) Date of Patent: Jan. 18, 2022

(54) CONTROL APPARATUS AND METHOD FOR COMBINATION SPACE AND WATER HEATING

(71) Applicant: GAS TECHNOLOGY INSTITUTE, Des Plaines, IL (US)

(72) Inventors: Paul Eric Glanville, Chicago, IL (US); Timothy A. Kingston, Arlington Heights, IL (US); Michael Christian Mensinger, Jr., Palatine, IL (US)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 62 days.

(21) Appl. No.: 16/413,253

(22) Filed: May 15, 2019

(65) Prior Publication Data

US 2019/0353399 A1 Nov. 21, 2019

Related U.S. Application Data

(60) Provisional application No. 62/671,517, filed on May 15, 2018.

(51) Int. Cl.

| | |
|---|---|
| ***F24H 6/00*** | (2006.01) |
| ***F24H 9/20*** | (2006.01) |
| ***F24H 1/43*** | (2006.01) |
| ***F24H 1/08*** | (2006.01) |
| ***F24D 19/10*** | (2006.01) |

(52) U.S. Cl.

CPC ..... *F24H 6/00* (2013.01); *F24D 19/1006* (2013.01); *F24H 1/08* (2013.01); *F24H 1/43* (2013.01); *F24H 9/2007* (2013.01)

(58) Field of Classification Search

CPC ... F24F 11/80; F24F 11/83; F24H 6/00; F24D 19/1006

See application file for complete search history.

(56) References Cited

U.S. PATENT DOCUMENTS

| | | | | |
|---|---|---|---|---|
| 3,341,122 | A | 9/1967 | Whittell, Jr. | |
| 4,798,240 | A | 1/1989 | Gerstmann et al. | |
| 4,925,093 | A * | 5/1990 | Moore, Jr. ..... | F24H 1/206 122/14.22 |
| 5,076,494 | A | 12/1991 | Ripka | |
| 5,361,751 | A | 11/1994 | Biggs | |
| 5,544,645 | A | 8/1996 | Armijo et al. | |
| 5,687,908 | A | 11/1997 | Talbert et al. | |

(Continued)

FOREIGN PATENT DOCUMENTS

| | | |
|---|---|---|
| CA | 2914194 | 12/2014 |

*Primary Examiner* — Jason Lau

(74) *Attorney, Agent, or Firm* — Pauley Erickson & Swanson

(57) ABSTRACT

An apparatus and system for a combination space and water heater including a controller device and a method for control. The controller device is a self-contained system that can be added to, or in combination with, existing water heaters and hydronic air heating systems using standard plumbing connections, and provides a potable water system without any need of an intermediary heat exchanger. The controller device automatically monitors a heating capacity of the water heater and the hydronic heating coil over time, and correlates measured heating loads with one or more environmental temperatures, thermostats, user settings, and/or a supplemental heating system.

13 Claims, 4 Drawing Sheets

(56) References Cited

U.S. PATENT DOCUMENTS

| | | | | |
|---|---|---|---|---|
| 6,334,411 | B1 | 1/2002 | Lesage et al. | |
| 6,347,748 | B1 | 2/2002 | Lyons | |
| 6,857,578 | B2 | 2/2005 | Alvarez et al. | |
| 8,126,595 | B2 | 2/2012 | Milder et al. | |
| 8,353,463 | B2 | 1/2013 | York et al. | |
| 8,403,234 | B2 | 3/2013 | Wolter | |
| 9,410,752 | B2 | 8/2016 | Wallace | |
| 2007/0187521 | A1 | 8/2007 | Wawak | |
| 2008/0179416 | A1 | 7/2008 | Johnson et al. | |
| 2016/0187894 | A1* | 6/2016 | Malky | F24D 19/1009 700/276 |
| 2017/0314800 | A1* | 11/2017 | Bengea | F24F 11/30 |

* cited by examiner

CONTROL APPARATUS AND METHOD FOR COMBINATION SPACE AND WATER HEATING

CROSS REFERENCE TO RELATED APPLICATION

This application claims the benefit of U.S. Provisional Patent Application, Ser. No. 62/671,517, filed on 15 May 2018. The Provisional Patent Application is hereby incorporated by reference herein in its entirety and is made a part hereof, including but not limited to those portions which specifically appear hereinafter.

BACKGROUND OF THE INVENTION

Field of the Invention

This invention relates generally to space and water heating systems and, more particularly, to a hydronic heating hub controller for combination space and water heating systems.

Description of Related Art

Packaged combination space and water heating systems are not new: Packaged equipment that are fuel-fired, with or without supplemental heating, are as old as hydronic heating equipment. Generally, such systems integrate domestic hot water (DHW) and forced air heat delivery within one package and do not send potable water to deliver space heating. More recently, this concept of a packaged combination space/water heating system has been applied to a storage tank form factor.

Packaged air handlers for combination space/water heating system are also known. For example, such systems commonly package an air handler with a circulation pump (and other means of controlling hydronic heating) and system controls.

Further, commercial hydronic heating systems and processing are also prevalent, and include known plumbing solutions. With the primary aim of packaging multiple components needed for typical commercial hydronic heating, such systems typically include control valves, pumps, and other components with the goal of reducing the cost and resources needed for installation.

More recently, controls of a combination space/water heating system have been proposed. Commercial hydronic heating is common, much more so than residential and as such there are numerous patents concerning the controls of commercial hydronic heating systems (generally driven by boilers).

Companies are developing products that may use engineered controls built into the air handler unit (AHU) to automate field-engineered methods for reducing leaving water temperature (LWT) in order to induce condensing water heater operation. These solutions require measuring LWT and controlling the pump speed with an electronically commutated motor (ECM) or other means, and measuring the leaving air temperature (LAT) and controlling the blower speed with an ECM.

Field-engineered component integration is another solution. This includes integrating additional hot water coils to increase thermal transfer and reduce LWT.

SUMMARY OF THE INVENTION

In accordance with one aspect of the invention, the invention provides an intermediary controller between the thermal engine (e.g., water heater) and a hydronic heating coil. The prior art packaged systems and controls of combination space/water heating systems generally have either focused on non-potable, generally commercial building-focused heating systems or embodiments of the complete system.

The invention includes a system for a combination space and water heater, wherein the system is or includes a controller device with sensors and plumbing adapted to install between a hydronic heating coil and a water heater. The controller device automatically infers thermal and physical properties of the water heater and the hydronic heating coil from measurements from the sensors. The combination space and water heater is desirably a potable water system (DHW) for the intended space, without any intermediary heat exchanger.

The invention further comprehends a combined water heating and space heating system. The system includes a water heating apparatus providing heated potable water and heated water for space heating, and also a space heating apparatus including a hydronic heating coil for accepting and conveying the heated water from the water heating apparatus. The space heating apparatus also includes an air handling unit to convey air in heat transfer communication with the hydronic heating coil. The system further includes an intermediary controller device interposed between the water heating apparatus and the space heating apparatus, and otherwise between these components and environmental conditions/sensors (e.g., outdoor measurements or a thermostat). A water circulating device, such as incorporated in an enclosure of the controller device, is provided for controlled circulating of water between the water heating apparatus and the space heating apparatus in response to one or more system sensors. One or more sensors and/or items of instrumentation are used to sense one or more water or space heating conditions to provide inputs for the controller device.

In accordance with one aspect of the invention, a control strategy and system designed to maximize thermal comfort and performance from a combination space/water heating system based on user input and machine learning is provided. The controller in one embodiment is a smart "box" comprised of a variable speed pump, control valves, sensors which can be plumbed between any water heater and hydronic coil to act as an intelligent combination space/water heating system. The controller infers the thermal and physical properties of the heater and coil and predicts the space heating and domestic hot water loading to balance thermal comfort, user safety, and operating efficiency. The controller also enables the features of a "smart thermostat" while controlling for conditions such as Legionella and anti-scalding, and providing fault detection.

The invention further includes a method of heating a space with a water heater and a hydronic heating coil, by automatically monitoring a heating capacity of the water heater and the hydronic heating coil over time, and correlating measured heating loads with one or more environmental temperatures, thermostats, user settings, and/or any supplemental heating system. Embodiments of the method further include: monitoring and storing data from sensors in combination with the hydronic heating coil, the water heater, and/or the space; automatically deducing hydronic heating coil characteristics through measurements of hydronic flow and hydronic and/or air-side temperatures, wherein the hydronic flow is measured indirectly with a flow switch or directly with a flow meter; defining a thermal response of the coil, such as using fixed or variable parameters (e.g., heat capacitance); calculating a transient energy balance; iteratively updating the parameters from initial or manually adjusted settings based on an error in estimated energy balance; and/or defining a thermal response of the hydronic heating coil as a function of two or more constants to define coil capacity as a function of entering hydronic and air temperatures.

The controller devices, systems, and methods of this invention, use a novel control method/strategy to accomplish one or more of the following: deduce the hydronic heating coil characteristics of an AHU; infer ideal heat pump/water heater switchover outside air temperature (OAT) condition in hybrid arrangements; predict AHU heating capacity; predict thermal response of the home; infer ideal heating loop water flow; infer ideal water heater target temperature; and/or infer ideal time duration between freshwater purges. The control method/strategy can be used to provide: AHU entering water temperature to deploy OAT water heater setback and warm-weather shutdown controls; AHU leaving water temperature to induce condensing water heater operation; AHU leaving air temperature to maintain comfortable delivered air; allow user-controlled operating modes (high heat, money saver, etc.); heating loop water flow to protect the circulating pump from cavitation and maintain heat capacity; cycle on-time to minimize cycling losses; AHU shut-off to maintain DHW priority; minimize impact of intermittent hot water ('cold water sandwiches'); heating loop freshwater purge valve to eliminate need for recirculation; and/or heat pump/water heater cutoff to deploy outdoor air temperature switchover.

In embodiments of this invention, the controller device automatically monitors the capacity of the water heater and the hydronic heating coil over time, and correlates measured heating loads with one or more environmental temperatures, thermostat activity, user settings, and/or a supplemental heating system.

In embodiments of this invention, the controller device monitors cycling and modulation of the water heater and/or a supplemental space heater including the hydronic heating coil. In embodiments of this invention, the controller device automatically senses the supplemental heating system from monitored performance information. The controller device automatically develops a performance model of the water heater and the hydronic heating coil over a timeframe, and operates the combination space and water heater as a function of the performance model.

In embodiments of this invention, the controller device: automatically deduces hydronic heating coil characteristics through measurement of hydronic flow and hydronic and/or air-side temperatures, wherein the hydronic flow is measured indirectly with a flow switch or directly with a flow meter; utilizes fixed or variable parameters to define a thermal response of the coil, such as heat capacitance; calculates a transient energy balance; iteratively updates the parameters from initial or manually adjusted settings based on an error in estimated energy balance; and defines a thermal response of the hydronic heating coil as a function of two or more constants to define coil capacity as a function of entering hydronic and air temperatures.

In embodiments of this invention, the controller device automatically and iteratively adjusts constants defining coil capacity as a function of hydronic and air temperatures based upon error analysis, to adjust for changes in the physical system or operating conditions.

In embodiments of this invention, the controller device stores and utilizes groups of constants defining coil capacity as a function of hydronic and air temperatures, based upon an input discrete or continuous fan speed signal, and hydronic flow.

In embodiments of this invention, the controller device automatically determines or predicts a hydronic air handler unit heating capacity by measuring hydronic and air temperatures input to the coil, and utilizing stored constants, hydronic flow, fan speed, and data of prior measurements.

In embodiments of this invention, the controller device automatically determines a thermal response of an indoor environment, an ideal heating loop water flow to balance operating efficiency and thermal comfort goals, an ideal water heater target temperature, and/or an ideal time duration between freshwater purges.

In embodiments of this invention, the controller adjusts the variable pump speed, the control valves, and/or control parameters specific to the water heater or hydronic heating coil (e.g., fan speed) to meet a desired goal, including user setting, outdoor setback curve, operating efficiency, operation of supplemental heating equipment, or other Other objects and advantages will be apparent to those skilled in the art from the following detailed description taken in conjunction with the appended claims and drawings.

DETAILED DESCRIPTION

The invention generally includes a hydronic heating hub controller, and method of operation or use, for controlling an interaction between a water heater, such as a tankless water heater, and hydronic air handler. The invention is suitable for use as a combined space and water heating system (a "combi system") for residential or commercial use. The controller, with limited or no information on the water heater of air handle components, manages performance of the combi system through balancing multiple goals over dynamic loading scenarios, including, for example: thermal comfort, domestic hot water priority, optimal thermal efficiency of the water heater component, safe operation of open (potable) hydronic heating systems, and functionality with multiple operating modes (outdoor temperature reset, user-set modes, etc.).

A typical open/potable combi system is made up of four primary components: a water heater (WH, often a tankless WH), a hydronic heating coil (HHC), an internal mixing valve, and a recirculating pump. When providing space heat, the recirculation pump creates a demand for the flow-activated tankless water heater, providing hot water to the HHC heat exchanger via a system loop. The supply fan passes air over the heat exchanger, providing warm air to the house. Cooled return water is recirculated back to the water heater via the same recirculation pump. When providing domestic hot water, at one or multiple fixtures the hot water is drawn off of the system loop, drawing in cold makeup water through the water input line. A thermostatic mixing valve blends cold water with hot water exiting the water heater, tempering to a desired temperature lower than the water heater's setpoint used for space heating. Hot water draws are possible during space heating mode, with an active recirculation pump, however commonly a flow switch and/or flow meter is used to detect hot water demand to interrupt pump operation and enforce "hot water priority".

Figure 1:
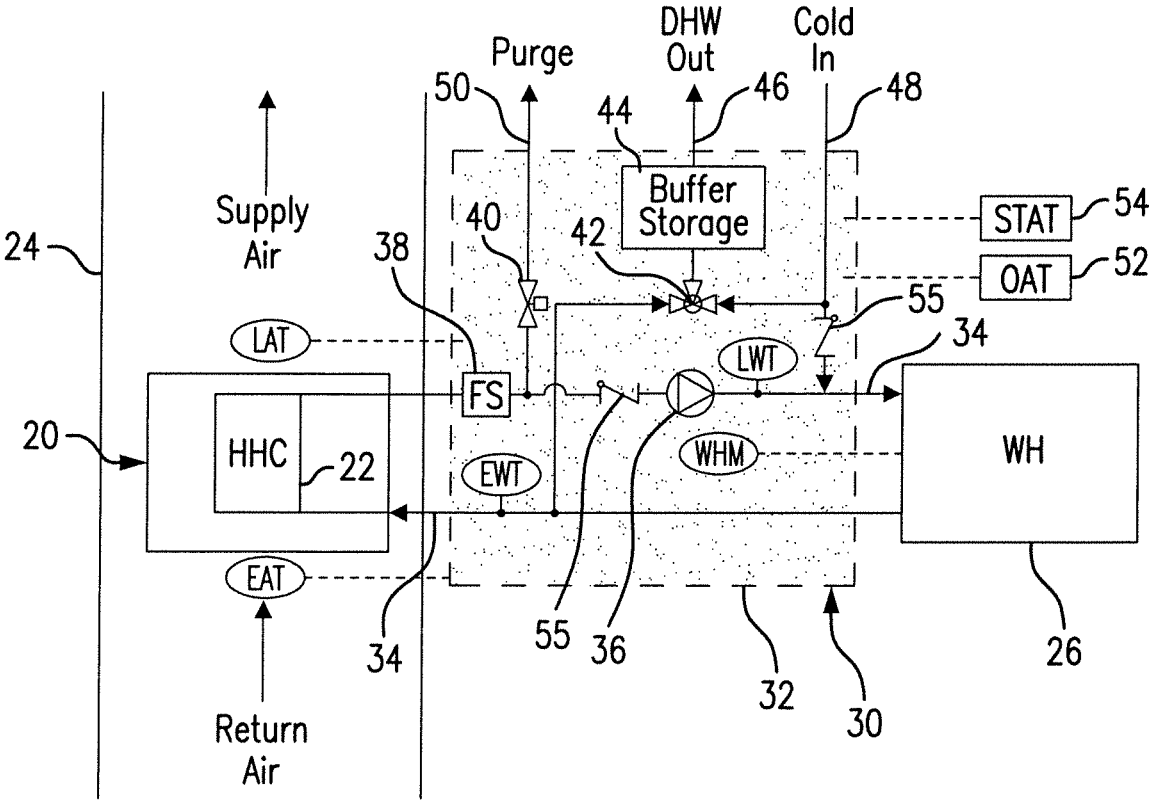
FIG. 1 illustrates a system for a combination space and water heater according to one embodiment of the invention.

FIG. 1 schematically shows a controller device 30 according to one embodiment of this invention for a combi system such as described above. FIG. 1 shows a hydronic air handler system 30, with a hydronic heating coil 22 in combination with an air duct 24, and a water heater 26. The controller 30 is installed, via suitable plumbing, as a middleware device between the hydronic heating coil 22 and the water heater 26.

The controller 30 is an independent device having a housing 32 that can be installed next to and attached to the hydronic heating coil 22 and/or water heater 26 via hydronic (e.g., water) conduits 34 (e.g., pipes). The controller 30 includes a variable speed recirculation pump 36 for circulating water between the water heater 26 and the coil 22. A flow switch 38 can be included to assist prioritization of domestic hot water over the air heating. The illustrated controller 30 includes a control valve 40 for purging to a drain. A thermostatic mixing valve 42 controls water temperature to a buffer storage 44, which can be used for limiting domestic hot water temperature fluctuations. Plumbing connections in FIG. 1 include water heater supply and return, coil supply and return, domestic hot water out 46, cold water in 48, and purge 50. Internal check valves 55 can be incorporated as needed.

The controller 30 includes, or is in combination with, a number of sensors or sensing device. Referring to FIG. 1, the controller includes a leaving water temperature sensor LWT, a water heater measurement sensor WHM, an entering water temperature sensor EWT, and entering air temperature sensor EAT, and a leaving air temperature sensor LAT. In addition, the controller 30 include or is in combination with an outside air temperature sensor (OAT) 52, and a thermostat (STAT) 54.

In accordance with one aspect of the invention, the invention provides an intermediary controller between the thermal engine (e.g., water heater) and a hydronic heating coil. As an intermediary, the invention uniquely "learns" the characteristics of the thermal engine and the hydronic heating coil: This unique feature of the invention is necessary as, to enable simple installations and optimal performance, it must be: (a) agnostic towards what coil and thermal engine it is integrating as a combination space/water heating system and (b) must adjust operation to accommodate multiple operating goals and shifts in system dynamics (e.g., seasonal heating demand changes, different user-defined operating modes). To accomplish this, the invention's onboard sensors/memory/controls (a) develop performance maps of the thermal engine/coil, (b) correlate measured DHW/space heating loads with outdoor temperature, user-setting, and the presence of supplemental heating (e.g., hybrid heat pump), and (c) use memory of cycling behavior to minimize cycling losses, infer duration between freshwater purges, and fault detection. Additionally, the invention can sense its use in hybrid arrangements, wherein hydronic heating is supplemented using lower-grade heating sources (heat pump, renewable) and properly manage the deployment of both space heating inputs.

The invention uniquely combines proven features to improve hydronic system performance while minimizing installation cost, while focusing on residential, potable-water only systems. The invention can integrate two separate, off-the-shelf components: a conventional water heater (tankless or storage type) and a hydronic heating coil for forced-air heating distribution. In accordance with one preferred embodiment, to simplify installation and ensure the provision of a "universal" integration tool, the bulk of necessary sensors, valving, and other equipment are advantageously contained within a single enclosure (such as housing 32 in FIG. 1), with standard plumbing and electrical connections. As the system uniquely does not require a heat exchanger, it is a 100% potable water system, the invention facilitates freshwater purges with an inferred frequency necessary to minimize energy loss while assuring safe operation (e.g., limit bacteria formation in standing warm water). While retaining the cost advantage of a potable-only hydronic system, the invention incorporates additional features including: outdoor temperature setback controls, warm-weather shutdown, return water temperature control to maximum condensing efficiency, and minimization of short-cycling through load management.

Figure 2:
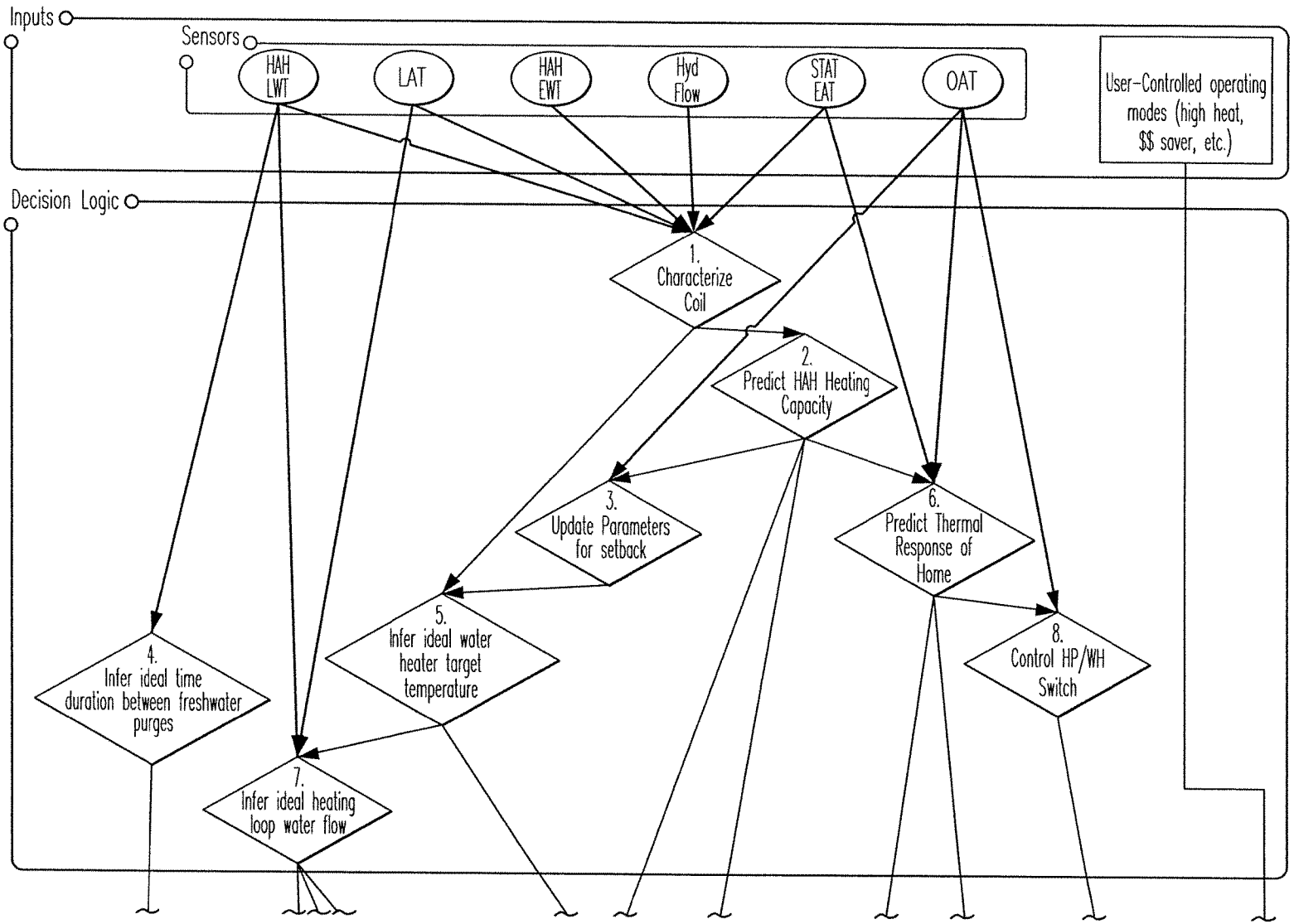
FIG. 2 is a schematic showing of a logic tree for a controller according to one embodiment of the invention.
Figure 2:
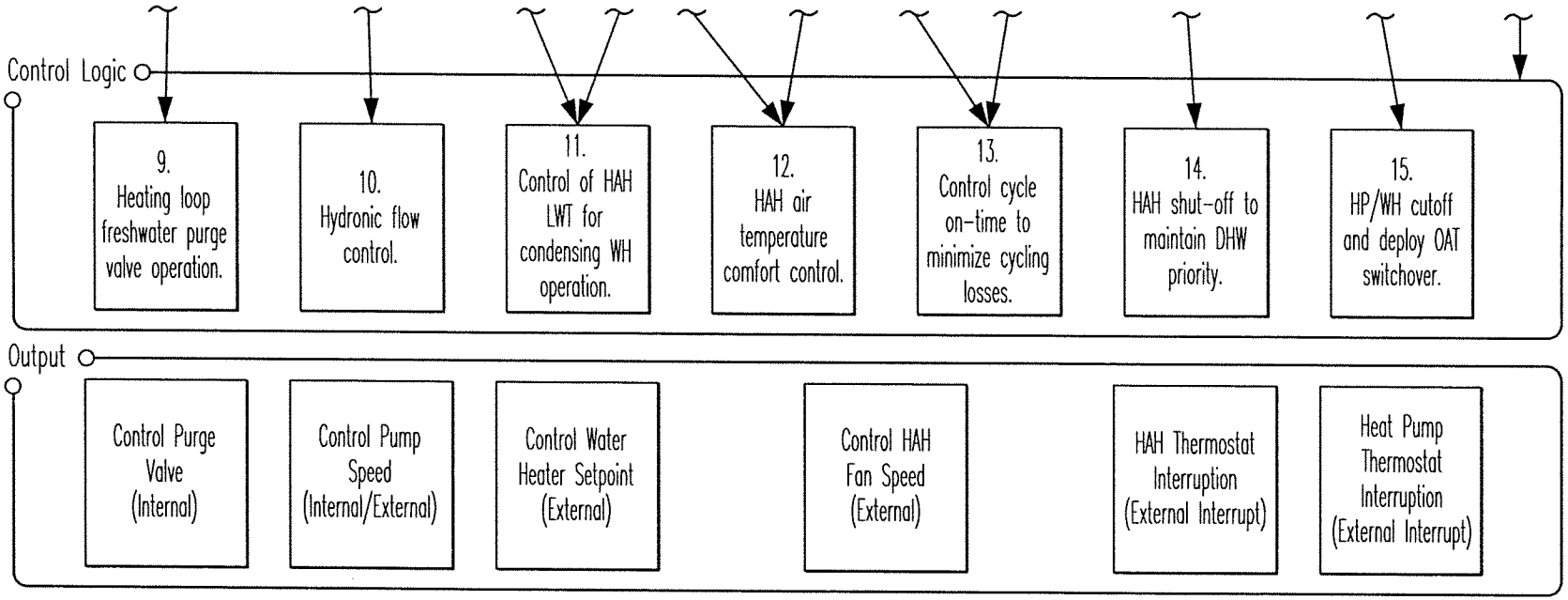

FIG. 2 is an exemplary logic diagram for the controller, according to one exemplary embodiments of the invention. Referring to FIG. 1, the controller 30 can continuously update input values, such as measured by the sensors, within its control module via a data processor and a non-transitory recordable medium (for storage and encoded software instructions for implementing the method steps). These input values include the entering water temperature (EWT) and leaving water temperature (LWT) from the coil 22, as measured within the controller 30. Hydronic flow is also measured within the controller 30, such as using flow switch 38. Alternative embodiments can employ an internal flow meter and/or read the flow meter signal from the water heater component. Outside air temperature (OAT) and leaving air temperature (LAT) are measured by sensors external of the controller 30. A thermostat signal (STAT) can be provided by a dry contact indicating a call for space heating. Additionally, the controller 30 may have user-settings (e.g., "energy saver", "high DHW priority", etc.) to serve as an additional input.

Using the exemplary numbering scheme in FIG. 2, the controller uses the inputs to update constants used to model the overall combi system. In embodiments of the invention, in Step 1, the HHC is characterized. The coil can be modeled as a simple water-to-air heat exchanger, such as defined by the following framework:

$$Q_{WH}=Q_{HHC};\quad m_{hyd}C_p(T_{EWT}-T_{LWT})=(UA_{HHC}(\Delta T)_{lmtd,HHC})*\Delta t$$

Here a simple energy balance is performed wherein the log-mean temperature difference (LMTD) is used where $T_{EWT}$, $T_{LWT}$, and $T_{LAT}$ are defined as measured, updated for each timestep (units can be ° F.); $T_{EAT}$ is the entering air temperature, which could be measured as $T_{LAT}$ during the initiation of a space heating on-cycle; $C_p$ and, if used, ρ are properties of water, functions of $T_{LWT}$, and pre-programmed into the controller; $UA_{HHC}$ is a pre-defined constant; $m_{hyd}$ is the mass of water flowing through the HHC over the given timestep, measured directly with flow meter or inferred from flow switch; and Δt is the timestep at which values are updated.

During an on-cycle, the controller can determine the error between the right-hand side (RHS) and left-hand side (LHS) of the energy balance. This error can be estimated as:

$$ERROR_1=\left(\frac{(RHS-LHS)}{RHS}\right)$$

Assuming that the error is contained within the $UA_{HHC}$ factor, the updated $UA_{HHC}$ can be defined as:

$$[UA_{HAC}]_{new}=[UA_{HHC}]_{old}*(1-\text{ERROR}_1)^{-1}$$

Step 2 includes predicting an HHC steady state heating capacity. Using the above information from Step 1, the controller can begin to define the capacity limitations of the HHC, that is, how the following function can be defined:

$$Q_{HHC}=f(T_{EWT},T_{EAT});$$

where the heat output of the HHC can be defined as a linear function of $T_{EWT}$ and $T_{EAT}$ and may also be a function of HHC fan speed.

Figure 3:
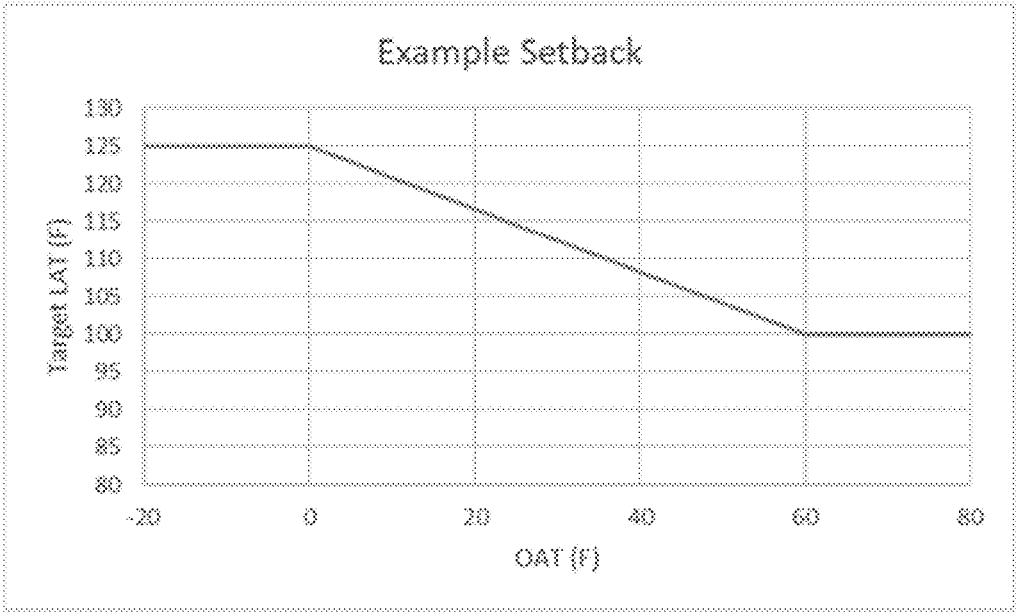
FIG. 3 is an example setback curve for a controller, according to one embodiment of the invention.

The controller updates parameters for setback in Step 3, with an example shown in FIG. 3. The temperature setback can be based on four values: target low temperature LAT (125° F. in FIG. 3); low temperature OAT (0° F. in FIG. 3); target warm temperature LAT (100° F. in FIG. 3; and warm temperature OAT (60° F. in FIG. 3). During this step, the controller can update some or all of these values based on results of the prior step, including the thermal response of the building and the user settings.

Step 4 of FIG. 2 includes inferring an ideal time duration between freshwater purges. The time between freshwater purges can be determined by the loop temperatures during standby, where standby can be determined by the time since the $T_{LWT}$ is at or below $T_{Purge}$ when no DHW is drawn, and a constant defined by the installation application and local health and safety codes. A purge can be initiated if this standby period, as defined, exceeds a period of $t_{purge}$ (e.g., 12 hours), which can be predetermined and hard-coded and similarly depend on application and local health and safety codes. During an automated purge, a recirculation pump can run at a low setting, and the duration of a purge, during which the purge valve is opened, can be based on an inferred or user-defined volume of piping.

Step 5 includes inferring an ideal water heater target temperature. Where the controller is able to interface, directly or indirectly, with the WH's setpoint temperature, this temperature target ($T_{EWT}$) can be varied for space heating functions only. The target temperature for DHW can be set by the user, as part of the user settings. Where the controller cannot control the WH's setpoint temperature ($T_{EWT}$), this user-defined temperature setting can be fixed. Where the controller can control the WH's setpoint temperature, the unit can: detect a DHW-only mode as activation of the WH component (via external sensor(s) on WH) without a call for heat (STAT) and maintain the user-defined temperature setting; and/or detect a space heating-only mode via a call for heat (STAT) and confirmation the circulation pump is operating (flow switch). In this latter scenario, the $T_{EWT}$ can be adjusted in one or more of the following ways when the adjustment in loop flow rate is unable to meet the goals: reduced to meet the LAT setback while increasing the duration of on-cycles; reduced to lower $T_{LWT}$ in order to improve WH operating efficiency; or increased to react to user setting changes and/or an anticipated extended recovery period ($T_{EAT}$<65° F. for example). If a DHW draw is detected during a space heating mode, such as can be confirmed by a sudden shift in $T_{EWT}$ and $T_{LWT}$, the $T_{EWT}$ target can be returned to the DHW-only setting for a defined period of time (e.g., 2 minutes).

Step 6 includes predicting a thermal response of the home (or other space). With $Q_{HHC}$ calculated in the Step 1, and updated for each time step, the total delivered heat to the space is known for each on-cycle. Coupled with known durations of off-cycles (between calls for heat), the controller 30 estimates the hourly heat load of the home ($Q_{Home}$) as a function of $T_{OAT}$. This may be assumed to be linear over the range of expected temperatures, and the fitting constants can be defined and updated on a daily basis.

This relationship establishes a starting target for circulation pump flow rate and $T_{EWT}$ (Steps 5 and 7). Time of day and the date, as a means of indirectly capturing solar heat gain, may be used to refine these constants if the correlation remains below an expected value. Predictions of $Q_{home}$ based on $T_{OAT}$ can be integrated with weather forecast data for predictive cycling, conservation, and/or other means of balancing efficiency with thermal comfort.

Step 7 includes inferring an ideal heating loop flow. With similar goals to Step 5, the recirculation pump flow rate during space heating mode is the primary control point of the controller. A primary goal is, through modulation of the heating rate, to maintain a $T_{LWT}$ as low as possible to ensure efficient operation, while assuring to maintain a $T_{LAT}$ in accordance with the setback curve. By extension, assure that $Q_{HHC}>F*Q_{home}$, where F can be a safety factor hard-coded in the system (e.g., 1.2).

Figure 4:
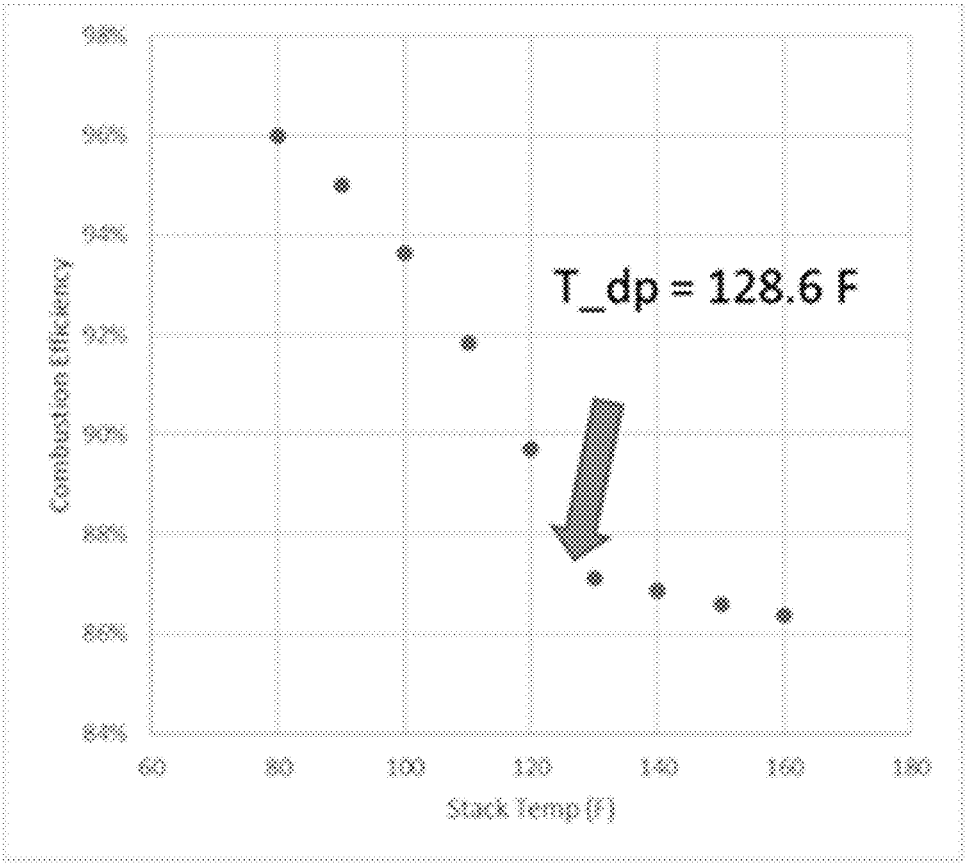
FIG. 4 is an example idealized curve of $T_{fluegas}$ vs. combustion efficiency.

The controller desirably, when operating in "non-learning" mode for the coil and if directly or indirectly inferring the flue gas temperatures, develops a correlation between $T_{fluegas}$ and $T_{LWT}$. When steady operation is detected in space heating mode, the system can identify the slope/intercept of the two lines for $T_{fluegas}$, for a given bin of $Q_{HHC}$. With FIG. 4 as an example, there is a pronounced "dog leg" when at the onset of condensing with respect to combustion efficiency. When tracking $T_{fluegas}$ as a function of $T_{LWT}$ for a fixed $Q_{HHC}$ and declining hydronic flow rate, similarly the flue gas temperature can shift at the onset of condensing and decline more gradually with decreasing $T_{LWT}$. For two or more steady operating points in each regime comparing $T_{fluegas}$ and $T_{LWT}$, the controller can linearize both regimes and determine what return water target is at the intersection.

If the controller is unable to make this calculation, it can stick with a pre-defined default target (such as 120° F.). The controller can work to maintain this return water temperature target, absent any superseding activities. For cycling rates during space heating modes, a target maximum cycling rate of cycles/hour is defined as a function of $T_{OAT}$ when the setback curve is used. If other criteria are met and this is not, the hydronic flow rate can be further reduced to meet this goal.

Step 8 includes controlling a supplemental heating device switch. For hybrid heating systems for example, with heat pumps operating in conjunction with the hydronic-based combi system, the controller determines a switchover point ($T_{switchover}$) based on prior assessments $Q_{home}$ as a function of $T_{OAT}$. When first configured, the controller uses a conservative estimate for $T_{switchover}$ (e.g., 40° F.) until $Q_{home}$ is determined as a function of $T_{OAT}$. Once $Q_{home}$ is mapped, $T_{switchover}$ can be decreased by given increment, after which the controller 'watches' to see if $T_{LAT}$ temperature declines during an extended STAT on-cycle (e.g., greater than 30 minutes), repeating this cycle to identify the $T_{switchover}$ that corresponds to the $Q_{home}$ and $T_{OAT}$ at the peak capacity of the heat pump. The controller continues to verify this value for $T_{switchover}$, adjusting as necessary to changes in heat pump performance, building envelope, or other operational aspect, however the controller is not expected to make frequent or significant changes with $T_{switchover}$.

The controller has the following outputs in FIG. 2 which are varied based on the control/decision logic: state of purge valve (open/closed); recirculation pump speed; WH setpoint temperature (if feasible); HHC fan speed (if available); STAT interruption; and/or heat pump STAT interruption.

Thus the invention provides a combination space and water heater including an intermediary/middleware controller and a method for control. The controller can be a self-contained system that can be added to, or in combination with, existing water heaters and hydronic air heating systems using standard plumbing connections. The controller uses input information that is independent on the particular brand/type of heaters. The combination space and water heater of this invention can be a potable water system without any need of an intermediary heat exchanger.

While in the foregoing detailed description this invention has been described in relation to certain preferred embodiments thereof, and many details have been set forth for purposes of illustration, it can be apparent to those skilled in the art that the invention is susceptible to additional embodiments and that certain of the details described herein can be varied considerably without departing from the basic principles of the invention.

What is claimed is:

1. A system for a combination space and water heater, the system comprising:

a controller device including sensors and plumbing adapted to install between a hydronic heating coil and a water heater, wherein the controller device automatically infers thermal and physical properties of the water heater and the hydronic heating coil from measurements from the sensors, wherein the controller device:

automatically deduces hydronic heating coil characteristics through measurement of hydronic flow and hydronic and/or air-side temperatures, wherein the hydronic flow is measured indirectly with a flow switch or directly with a flow meter;

utilizes fixed or variable parameters to define a thermal response of the coil, the parameters including heat capacitance;

calculates a transient energy balance;

iteratively updates the parameters from initial or manually adjusted settings based on an error in estimated energy balance; and defines a thermal response of the hydronic heating coil as a function of two or more constants to define coil capacity as a function of entering hydronic and air temperatures.

2. The system of claim 1, wherein the plumbing comprises a water conduit, a variable speed pump, and control valves.

3. The system of claim 2, wherein the plumbing comprises a buffer storage vessel.

4. The system of claim 1, wherein the combination space and water heater is a potable water system without an intermediary heat exchanger.

5. The system of claim 1, wherein the controller device automatically and iteratively adjusts constants defining coil capacity as a function of hydronic and air temperatures based upon error analysis, to adjust for changes in the physical system or operating conditions.

6. The system of claim 1, wherein the controller device stores and utilizes groups of constants defining coil capacity as a function of hydronic and air temperatures, based upon an input discrete or continuous fan speed signal, and hydronic flow.

7. The system of claim 1, wherein the controller device automatically determines or predicts a hydronic air handler unit heating capacity by measuring hydronic and air temperatures input to the coil, and utilizing stored constants, hydronic flow, fan speed, and data of prior measurements.

8. The system of claim 1, wherein the controller device automatically determines a thermal response of a space, an ideal heating loop water flow to balance operating efficiency and thermal comfort goals, an ideal water heater target temperature, and/or an ideal time duration between freshwater purges.

9. The system of claim 7, wherein the controller adjusts the variable pump speed, the control valves, and/or control parameters specific to the water heater or hydronic heating coil to meet a desired goal, including user setting, outdoor setback curve, operating efficiency, or operation of supplemental heating equipment.

10. The system of claim 1, wherein the water heater provides heated potable water and heated water for space heating, and the hydronic heating coil accepts and conveys the heated water for space heating from the water heater, and further comprising:

an air handling unit in combination with the hydronic heating coil to convey air in heat transfer communication with the hydronic heating coil;

a water circulating device for controlled circulating of water between the water heater and the hydronic heating coil in response to the sensors; and wherein the sensors and/or items of instrumentation sense one or more water or space heating conditions to provide inputs for the controller device.

11. The system of claim 1, further comprising a water heating apparatus including the water heater and providing heated potable water and heated water for space heating;

a space heating apparatus, the space heating apparatus including the hydronic heating coil for accepting and conveying heated water from the water heating apparatus, the space heating apparatus also including an air handling unit to convey air in heat transfer communication with the hydronic heating coil;

a water circulating device for controlled circulating of water between the water heating apparatus and the space heating apparatus in response to the sensors, and wherein the sensors and/or items of instrumentation sense one or more water or space heating conditions to provide inputs for the controller device.

12. The system of claim 11, wherein the controller device automatically monitors a heating capacity of the water heater and the hydronic heating coil over time, and correlates measured heating loads with one or more environmental temperatures, thermostats, user settings, and/or a supplemental heating system.

13. A system for a combination space and water heater, the system comprising:

a controller device including sensors and plumbing adapted to install between a hydronic heating coil and a water heater, wherein the controller device automatically infers thermal and physical properties of the water heater and the hydronic heating coil from measurements from the sensors, the controller device including a model of the water heater and the hydronic heating coil developed by the controller device from the measurements of the sensors, and the controller device configured to control operation of the combination space and water heater as a function of the model, and continually update the model using further sensor readings during the operation;

wherein the controller device is configured to correlate measured heating loads with more than one of: environmental temperatures, thermostats, user settings, or a supplemental heating system by: automatically deducing hydronic heating coil characteristics through measurements of hydronic flow and hydronic and/or air-side temperatures; defining a thermal response of the coil; calculating a transient energy balance; iteratively updating the parameters from initial or manually adjusted settings based on an error in estimated energy balance; and defining a thermal response of the hydronic heating coil as a function of two or more constants to define coil capacity as a function of entering hydronic and air temperatures.

* * * * *